US008552280B2

(12) United States Patent
Ishida

(10) Patent No.: US 8,552,280 B2
(45) Date of Patent: Oct. 8, 2013

(54) KEYBOARD DEVICE FOR ELECTRONIC KEYBOARD INSTRUMENT AND MOUNTING STRUCTURE OF LET-OFF IMPARTING MEMBER FOR ELECTRONIC KEYBOARD INSTRUMENT

(71) Applicant: Kabushiki Kaisha Kawai Gakki Seisakusho, Hamamatsu (JP)

(72) Inventor: Hideyuki Ishida, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 13/629,429

(22) Filed: Sep. 27, 2012

(65) Prior Publication Data

US 2013/0074683 A1 Mar. 28, 2013

(30) Foreign Application Priority Data

Sep. 28, 2011 (JP) ..... 2011-211820
Sep. 30, 2011 (JP) ..... 2011-216191

(51) Int. Cl.
*G10C 3/12* (2006.01)

(52) U.S. Cl.
USPC ..... 84/433

(58) Field of Classification Search
USPC ..... 84/719, 720, 744, 748, 236, 745, 245, 84/323
See application file for complete search history.

(56) References Cited

U.S. PATENT DOCUMENTS 5,571,983 A * 11/1996 Yamaguchi et al. ..... 84/745

FOREIGN PATENT DOCUMENTS

JP 2010-262129 11/2010

* cited by examiner

*Primary Examiner* — Kimberly Lockett
(74) *Attorney, Agent, or Firm* — Christie, Parker & Hale, LLP

(57) ABSTRACT

A keyboard device for an electronic keyboard instrument, which enables facilitation of work for mounting and dismounting a key switch and install hammers and the key switch with high accuracy, and provision of a touch feeling similar to one provided by an acoustic grand piano while keeping the device compact in depth. The device comprises swingable keys, a hammer support formed by a synthetic resin molded article, hammers pivotally supported by the hammer support, and a key switch including switch bodies provided in association with the hammers and a switch board. The hammer support has a switch mounting part formed with an opening vertically extending therethrough. The key switch is removably mounted to the switch mounting part, with the switch bodies facing the hammers from above via the opening and the switch board placed on the upper surface of the switch mounting part.

5 Claims, 9 Drawing Sheets

KEYBOARD DEVICE FOR ELECTRONIC KEYBOARD INSTRUMENT AND MOUNTING STRUCTURE OF LET-OFF IMPARTING MEMBER FOR ELECTRONIC KEYBOARD INSTRUMENT

CROSS-REFERENCE TO RELATED APPLICATION

This application claims priority to and the benefit of Japanese Patent Application Number 211820/2011, filed on Sep. 28, 2011, and Japanese Patent Application Number 216191/2011, filed on Sep. 30, 2011, the entire disclosures of which are incorporated herein by reference.

BACKGROUND OF THE INVENTION

1. Field of the Invention

The present invention relates to a keyboard device which is applied to an electronic keyboard instrument, such as an electronic piano, and a mounting structure of a let-off imparting member for imparting a let-off feeling closely analogous to a let-off feeling provided by an acoustic piano.

2. Description of the Related Art

Conventionally, as a keyboard device for an electronic piano, there has been known one disclosed e.g. in Japanese Laid-Open Patent Publication (Kokai) No. 2010-262129 filed by the present assignee. The keyboard device includes a plurality of swingable keys, a plurality of hammers provided in association with the respective keys and each configured to pivotally move in accordance with depression of an associated key, and a key switch for detecting key depression information on the keys. Each of the keys is swingably supported by a balance pin erected through a balance pin hole formed in a central portion of the key in the front-rear direction. Each of the hammers is pivotally supported by a metal action chassis formed into a predetermined shape by extrusion processing, via a bearing in the rear end of the hammer, and is placed on the rear end of the upper surface of the associated key via a capstan screw screwed into the hammer from below at a predetermined location forward of the bearing. The key switch is comprised of a switch board formed by a printed circuit board and a plurality of switch bodies provided on the hammer side of the printed circuit board in association with the respective hammers. The key switch is mounted to the lower side of a switch mounting part formed in the upper portion of the action chassis. More specifically, the rear end of the switch board is engaged with the base portion of the switch mounting part, and the front end of the switch board is secured to the switch mounting part with screws via a spacer.

Further, in the keyboard device, the ratio between a length from the front end of a key to an associated balance pin (hereinafter referred to as "the key front portion length") and a length from the balance pin to a capstan screw via which an associated hammer is in abutment with the key (hereinafter referred to as "the key rear portion length") is set to approximately 3:2.

Further, the keyboard device for an electronic keyboard instrument, disclosed in Japanese Laid-Open Patent Publication (Kokai) No. 2010-262129, is equipped with a let-off function for imparting a let-off feeling. In the keyboard device, each hammer that pivotally moves in accordance with depression of an associated key is pivotally supported by the action chassis formed by the metal extrusion molded article, as will be described hereinbelow. The keyboard device has let-off members provided in association with the respective hammers, and when a key is depressed, an engaging projection of an associated hammer comes into temporary engagement with an associated one of the let-off members during a pivotal motion of the hammer, whereby a let-off feeling is imparted to the touch feeling of the depressed key.

Each let-off member includes a mounting part and a body part extending forward and downward from the mounting part. The thus constructed let-off member has the mounting part mounted to a holder and the body part mounted to the upper portion of the action chassis via the holder in facing relation to an associated hammer. More specifically, the let-off members associated with the respective hammers are mounted to the holder extending in the left-right direction, and the holder is fixedly secured to the action chassis with screws, whereby the let-off members are mounted to the action chassis, in a state arranged side by side in the left-right direction.

The above-described keyboard device is configured such that the key switch is mounted to the lower side of the switch mounting part of the action chassis, which makes key switch mounting work troublesome. In addition, e.g. when adjustment is necessitated after mounting of the key switch to the action chassis during manufacturing of the electronic piano, or when maintenance of the electronic piano is necessitated, as well, work for dismounting the key switch from the action chassis and subsequent work for mounting the key switch again are troublesome.

Further, since the switch board of the key switch is secured to the action chassis with screws via the spacer, there is a fear that the switch board of the key switch or the switch bodies cannot be appropriately positioned with respect to the hammers with high accuracy e.g. due to a dimensional error in manufacturing of the spacer.

Furthermore, generally, an electronic piano is demanded to be made compact in the depth dimension, and hence the length of an entire key in the front-rear direction is set to be shorter than that in an acoustic grand piano (hereinafter simply referred to as "the grand piano"). Further, in the conventional keyboard apparatus, the ratio between the key front portion length and the key rear portion length is set to approximately 3:2 as mentioned above, and therefore the key front portion length of the keyboard apparatus is far shorter than that of the grand piano. For this reason, when an electronic piano provided with the above-described keyboard device is played on, the difference in load e.g. between depression of a portion of a key close to the front end thereof and depression of a portion of the key rearwardly remote from the front end is larger than when a grand piano is played on, which makes it impossible to obtain touch feeling sufficiently similar to that provided by the grand piano. Thus, the above-described keyboard device leaves room for improvement.

Further, in the above-described keyboard device, the engaging projection of each hammer is engaged with and disengaged from the distal end of an associated let-off member, whereby a let-off feeling is imparted. For this reason, it is demanded that the relationship between the hammer and the let-off member, the attitude of the entire let-off member, and the position of the distal end of the same have high accuracy. However, in the conventional keyboard device, since the let-off members are mounted to the action chassis via the holder secured to the action chassis with screws as described hereinabove, the let-off members sometimes cannot be accurately positioned with respect to the respective hammers directly mounted to the action chassis. In addition, when variation occurs in the attitude or the position of the distal end between the let-off members, there is a fear that a let-off feeling cannot be uniformly and stably imparted to all the keys during key depression. Therefore, the above-described keyboard device leaves room for improvement in respect of the mounting structure of a let-off member as well.

SUMMARY OF THE INVENTION

It is a first object of the present invention to provide a keyboard device for an electronic keyboard instrument, which makes it possible to facilitate work for mounting and dismounting a key switch and install hammers and the key switch with high accuracy, and make a key front portion length longer and a key rear portion length shorter than in a conventional electronic keyboard instrument, with the result that it is possible to obtain a touch feeling similar to a touch feeling provided by an acoustic grand piano while keeping the keyboard device compact in the depth dimension.

It is a second object of the present invention to provide a mounting structure of a let-off imparting member for an electronic keyboard instrument, which makes it possible to position let-off imparting members with respect to respective hammers with high accuracy, thereby enabling the let-off imparting members to uniformly and stably impart a let-off feeling to all the respective associated keys, during key depression.

To attain the above first object, in a first aspect of the present invention, there is provided a keyboard device for an electronic keyboard instrument, comprising a plurality of keys each extending in a front-rear direction and configured to be swingable about a fulcrum disposed at a predetermined location in the front-rear direction, a hammer support formed by a molded article of a synthetic resin and disposed rearward of the keys, a plurality of hammers each pivotally supported by the hammer support and held in abutment with an abutment portion of a rear end of an associated one of the keys from above, for pivotal motion in accordance with depression of the associated key, and a key switch including a plurality of switch bodies provided in association with the respective hammers and a switch board having the switch bodies mounted on a lower surface thereof, the key switch being configured to be operable when any of the hammers configured to pivotally move in accordance with depression of the respective keys presses an associated one of the switch bodies, to detect key depression information on the depressed key, wherein the hammer support has a switch mounting part located above the hammers and formed with an opening vertically extending therethrough, and wherein the key switch is removably mounted to the switch mounting part, such that the switch bodies face the respective hammers from above via the opening of the switch mounting part and the switch board is placed on an upper surface of the switch mounting part.

With this arrangement, the hammer support disposed rearward of the keys has the switch mounting part located above the hammers, and the key switch having the switch bodies and the switch board is mounted to the switch mounting part. Specifically, the key switch is removably mounted to the switch mounting part, with the switch bodies facing the respective hammers from above via the opening of the switch mounting part and the switch board placed on the upper surface of the switch mounting part. This makes it possible to mount the key switch to the switch mounting part of the hammer support from above and dismount the same upward, which facilitates key switch mounting work and dismounting work. Further, since the hammer support is formed by a molded article of a synthetic resin, it is possible not only to form the hammer support accurately, but also to install the hammers to be pivotally supported by the hammer support and the key switch to be mounted in a state placed on the hammer support, with high accuracy. Consequently, even when the key front portion length is set to be longer and the key rear portion length is set to be shorter than the respective lengths of the key of the conventional keyboard device for an electronic piano, it is possible to accurately detect key depression information on a depressed key by the key switch having an associated switch body pressed by a hammer pivotally moved by depression of the key.

Preferably, each of the keys is configured such that a ratio between a key front portion length defined as a length from a front end of the key to the fulcrum and a key rear portion length defined as a length from the fulcrum to the abutment portion is set to be within a range of 2:1 to 2.4:1.

According to this preferred embodiment, since the ratio between the key front portion length and the key rear portion length is set to be within the range of 2:1 to 2.4:1, it is possible to make the key front portion length longer than that in the conventional keyboard device while keeping the keyboard device as compact in the depth dimension as the conventional keyboard device for an electronic piano. In other words, although the entire length of the key is set to be approximately equal to that of the key in the conventional keyboard device, it is possible to secure for the key front portion length a length approximately equal to a key front portion length in an acoustic grand piano.

More preferably, the key front portion length of each of the keys is set to be approximately equal to a key front portion length of each key swingable about an associated fulcrum in an acoustic grand piano.

According to this preferred embodiment, since the key front portion length of each of the keys is approximately equal to that of the key in the acoustic grand piano, it is possible to obtain a touch feeling similar to a touch feeling provided by the acoustic grand piano.

To attain the above second object, in a second aspect of the present invention, there is provided a mounting structure of a let-off imparting member for an electronic keyboard instrument, provided in a keyboard device of the electronic keyboard instrument, which has a let-off function for imparting a let-off feeling similar to a let-off feeling provided by an acoustic piano, and is configured to be operable when a hammer pivotally moving in accordance with depression of a key comes into temporary engagement with the let-off imparting member during halfway through the pivotal motion, to thereby impart the let-off feeling to a touch feeling provided by the depressed key, the mounting structure comprising a hammer support for pivotally supporting the hammer, wherein the let-off imparting member is directly mounted to the hammer support.

With this arrangement, since the let-off member is directly mounted to the hammer support pivotally supporting the hammer, the let-off member can be positioned with respect to the hammer with high accuracy differently from a conventional let-off member mounted to the action chassis that supports the hammer via a holder. As a consequence, it is possible to impart a let-off feeling stably to a key associated with the hammer during depression of the key.

Preferably, the let-off imparting member comprises a plurality of let-off imparting members, and each of the let-off imparting members includes a mounting part, and a body part extending forward and downward from a lower end of the mounting part toward an associated hammer, the hammer support comprising a hammer supporting part for pivotally supporting a plurality of hammers associated with a plurality of keys, respectively, in a state arranged side by side in a left-right direction, a plurality of mounting holes formed in a manner associated with the hammers, respectively, and arranged side by side in the left-right direction, such that each of the let-off imparting members is mounted therein, in a state in which the mounting part is inserted therethrough, and an abutment wall formed at a location close to the mounting holes in a manner protruding downward, for abutment with a portion of each of the let-off imparting members which is lower than the associated mounting hole and is on a side of the body part opposite from a front end thereof in terms of a direction in which the body part extends.

According to this preferred embodiment, each of the let-off imparting members has the mounting part, and the body part extending forward and downward from the lower end of the mounting part toward an associated hammer. On the other hand, the hammer support pivotally supports the hammers arranged side by side in the left-right direction in association with the respective keys by the hammer supporting part. Further, the hammer support has the mounting holes formed in association with the respective keys in a manner arranged side by side in the left-right direction. Each of the let-off imparting members is mounted in the associated mounting hole, in a state in which the mounting part is inserted therethrough. Further, the abutment wall protruding downward is formed at a location close to the mounting holes, and the predetermined portion of each of the let-off imparting members is held in abutment with the abutment wall. Specifically, the predetermined portion is a portion of each let-off imparting member mounted in an associated mounting hole, which is lower than the mounting hole and is on a side opposite from a front end of the body part in terms of a direction in which the body part extends.

As described above, each of the let-off imparting members mounted to the hammer support via the respective mounting holes has its positions in the vertical and front-rear directions determined by an associated one of the mounting holes and the attitude of its downwardly extending body part determined by the abutment wall. Therefore, by appropriately setting the positions and sizes of the mounting holes and the abutment wall of the hammer support, it is possible to uniformly align the let-off members in position and attitude in the left-right direction without causing any variation between the let-off members. As a consequence, a let-off feeling can be uniformly and stably imparted to each of the keys during depression of the key.

The above and other objects, features, and advantages of the present invention will become more apparent from the following detailed description taken in conjunction with the accompanying drawings.

BRIEF DESCRIPTION OF THE DRAWINGS

FIGS. 4A and 4B are views useful in explaining the relationship between a key front portion length defined as a length from the front end of a key to a balance pin and a key rear portion length defined as a length from the balance pin to the rear end of the key with which a capstan screw abuts, in which FIG. 4A shows the keyboard device of the present embodiment, and FIG. 4B shows a conventional keyboard device for an electronic piano;

FIGS. 5A and 5B are perspective views of the hammer support, in which FIG. 5A shows an entire one-octave hammer support, and FIG. 5B shows a cut-away part of the same;

FIGS. 6A and 6B are views of the hammer support, in which FIG. 6A is a plan view, and FIG. 6B is a front view;

FIGS. 8A and 8B are views of the let-off member(s), in which FIG. 8A is a perspective view of a plurality of let-off members in a state continuously connected to each other, and FIG. 8B is a side view of a let-off member;

DETAILED DESCRIPTION OF PREFERRED EMBODIMENTS

Figure 1:
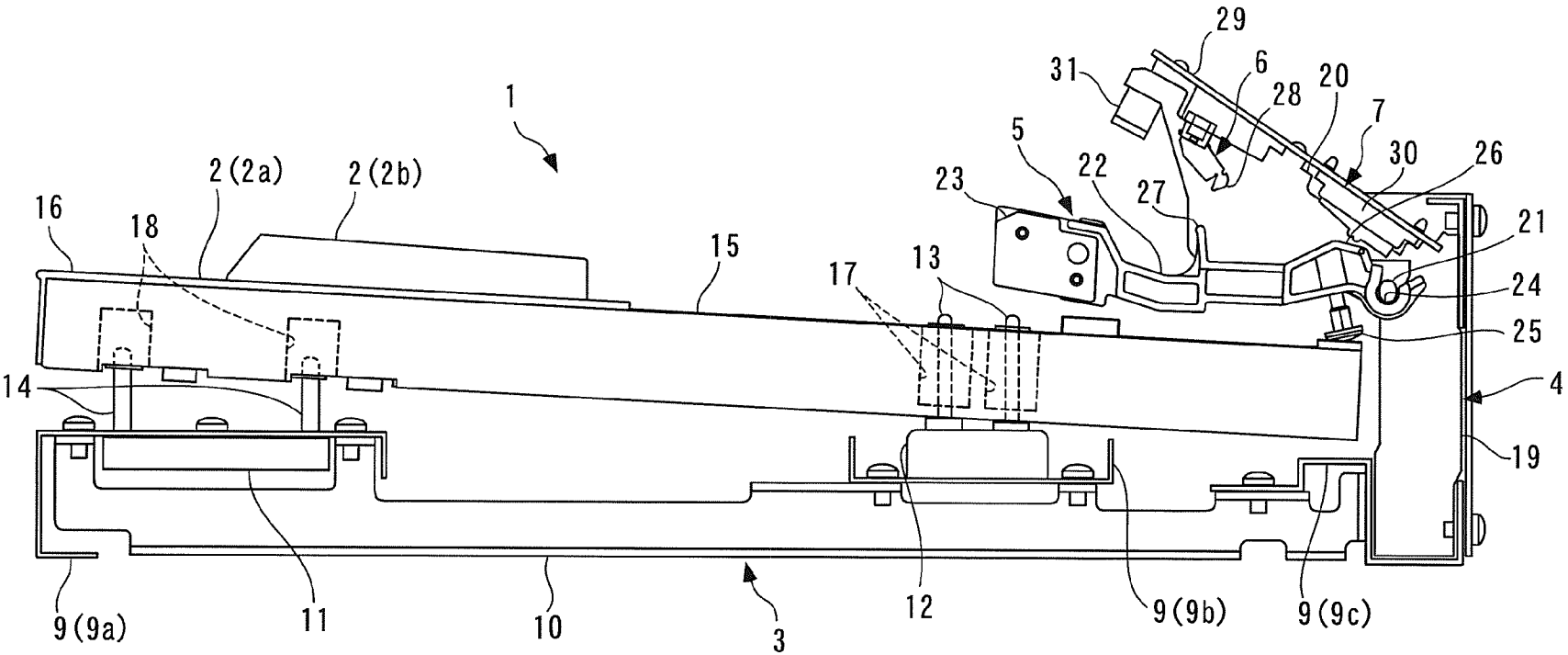
FIG. 1 is a partially cut-away side view of a keyboard device for an electronic piano, to which is applied a mounting structure of a let-off imparting member according to an embodiment of the present invention.

The present invention will now be described in detail with reference to the drawings showing a preferred embodiment thereof. FIG. 1 shows a keyboard device for an electronic piano, to which is applied a mounting structure of a let-off imparting member according to an embodiment of the present invention, in a key-released state.

As shown in FIG. 1, the keyboard device 1 includes a plurality of keys 2 (only one of white keys 2*a* and one of black keys 2*b* are shown) arranged side by side in a left-right direction (depth direction as viewed in FIG. 1) of the electronic piano, a keyboard chassis 3 for supporting the keys 2, a hammer support 4 connected to the rear end (right end as viewed in FIG. 1) of the keyboard chassis 3, a plurality of hammers 5 (only one of which is shown) each provided for an associated one of the keys 2, for being pivotally moved in accordance with depression of the key 2, a plurality of let-off members 6 (only one of which is shown) each provided for an associated one of the hammers 5, for adding a let-off feeling to the touch feeling of the associated key 2 when the key 2 is depressed, and a key switch 7 for detecting key depression information on the keys 2.

The keyboard chassis 3 is formed by assembling three support rails 9, i.e. a front rail 9*a*, a central rail 9*b*, and a rear rail 9*c* each extending in the left-right direction, and five reinforcement ribs 10 extending in the front-rear direction, in parallel crosses. The keyboard chassis 3 is secured on a keybed (not shown). Each of the support rails 9 and the ribs 10 is made of iron plate formed into a predetermined shape by press blanking and bending. Each support rail 9 is formed to have a reduced thickness (e.g. 1.0 mm) for reduction of weight, whereas each rib 10 is formed to have an increased thickness (e.g. 1.6 mm) for reinforcement.

A keyframe front 11 is secured to the lower surface of the front rail 9*a*, and a keyframe center 12 is secured to the upper surface of the central rail 9*a*. The keyframe front 11 and the keyframe center 12 each formed as a thick flat plate member of a synthetic resin extend in the left-right direction along the entire front rail 9*a* and the entire central rail 9*b*, respectively. On the keyframe center 12, a large number of balance pins 13 (fulcrums) are erected at respective front and rear locations corresponding to the white keys 2*a* and the black keys 2*b*, respectively, in a manner arranged side by side in the left-right direction. Further, on the keyframe front 11, a large number of front pins 14 are erected at respective front and rear locations corresponding to the white keys 2*a* and the black keys 2*b*, respectively, in a manner arranged side by side in the left-right direction.

Each of the keys 2 is comprised of a wooden key body 15 extending in the front-rear direction and having a rectangular cross section, and a key cover 16 made of a synthetic resin and bonded to the top and front surfaces of a front half of the key body 15. A portion of the key body 15 rearward of the center of the key body 15 is formed with balance pin holes 17, and the key 2 is pivotally supported by balance pins 13 via the balance pin holes 17. Further, a front end of the key body 15 is formed with front pin holes 18, and engagement between the front pin holes 18 and the respective front pins 14 prevents the key 2 from laterally swinging during a pivotal motion thereof.

The hammer support 4 is made of a synthetic resin and formed by connecting a plurality of molded articles, each covering e.g. one octave, to each other. The hammer support 4 extends over the length of all the hammers 5 in the left-right direction, and is fixed to the rear rail 9*c* of the keyboard chassis 3 with screws. The hammer support 4 includes a hammer supporting part 19 erected from near the rear rail 9*c*, and a switch mounting part 20 extending forward and obliquely upward from an upper end of the hammer supporting part 19. The upper end of the hammer supporting part 19 is formed with a horizontal pin-shaped fulcrum shaft 21 for supporting the hammers 5.

Each of the hammers 5 is comprised of an arm-like hammer body 22 extending in the front-rear direction, and weight plates 23 (only one of which is shown) attached to left and right sides of the front end of the hammer body 22, respectively. The hammer body 22 is made of a synthetic resin, while the weight plates 23 are each made of a metal material, such as iron, having a relatively high specific gravity. The hammer body 22 has a rear end thereof formed with an arcuate shaft hole 24. The shaft hole 24 is engaged with the fulcrum shaft 21, whereby the hammer 5 is pivotally supported on the hammer support 4.

Further, a capstan screw 25 is movably screwed into the lower surface of the hammer body 22 at a location slightly forward of the shaft hole 24. The hammer 5 is placed on the rear end of the associated key 2 via the capstan screw 25. A portion of the upper surface of the hammer body 22 between the shaft hole 24 and the capstan screw 25 functions as an actuator portion 26 for causing the key switch 7 to operate when the key 2 is depressed. Further, on a central portion of the upper surface of the hammer body 22 in the front-rear direction, there is formed a plate-like engaging projection 27 that is brought into engagement with an associated let-off member 6 when the key 2 is depressed.

The let-off member 6 is formed by a molded article of a predetermined elastic material (e.g. styrene-based thermoplastic elastomer), and is mounted to the switch mounting part 20 of the hammer support 4. The let-off member 6 extends rearward and downward from the switch mounting part 20, and has an end thereof formed as a head part 28 projecting from a neck part 73. In a key-released state, the head part 28 is opposed to the engaging projection 27 of the hammer 5.

The key switch 7 is comprised of a switch board 29 formed by a printed circuit board, and switch bodies 30 each formed by a rubber switch and attached to the lower surface of the switch board 29 in association with the keys 2, respectively. The switch board 29 has a rear end thereof inserted in the switch mounting part 20 and a front end and a central portion thereof fixed to the switch mounting part 20 with screws. In a key-released state of each key 2, the associated switch body 30 is opposed to the actuator portion 26 of the associated hammer 5 in a manner slightly spaced therefrom. On the front end of the lower surface of the switch mounting part 20, there is provided a hammer stopper 31 made e.g. of foamed urethane and configured to restrict upward pivotal motion of the hammer 5.

Next, a description will be given of the operation of the keyboard device 1 constructed as above. When depressed from the key-released state shown in FIG. 1, the key 2 pivotally moves about the balance pins 13 in the counterclockwise direction as viewed in FIG. 1, and in accordance with this pivotal motion, the hammer is pushed up via the capstan screw 25 to pivotally move upward (clockwise as viewed in FIG. 1) about the fulcrum shaft 21.

During halfway through the pivotal motion of the hammer 5, the engaging projection 27 is brought into engagement with the head part 28 of the let-off member 6 to cause the head part 28 to press the let-off member 6 while compressing the same, whereby a reaction force acting on the hammer 5 from the let-off member 6 is increased. When the hammer 5 further pivotally moves, the engaging projection 27 is disengaged from the head part 28, whereby the reaction force from the let-off member 6 suddenly disappears. The increase and sudden disappearance of the reaction force from the let-off member 6 gives let-off feeling closely similar to that of an acoustic piano.

Then, when the hammer 5 comes into abutment with the hammer stopper 31, the upward pivotal motion of the hammer 5 is stopped. During the upward pivotal motion of the hammer 5, the actuator portion 26 presses the switch body 30 of the key switch 7 to thereby turn on the key switch 7, whereby key depression information on the key 2 corresponding to the amount of pivotal motion of the hammer 5 is detected and output to a tone generation controller (not shown). The tone generation controller controls the tone generation of the electronic piano based on the detected key depression information.

Thereafter, when the key 2 is released, the key 2 performs pivotal motion in a direction reverse to the direction of pivotal motion of the key 2 when depressed, and returns to the key-released state shown in FIG. 1, and accordingly, the hammer 5 also pivotally moves downward to return to the key released state.

Figure 2A:
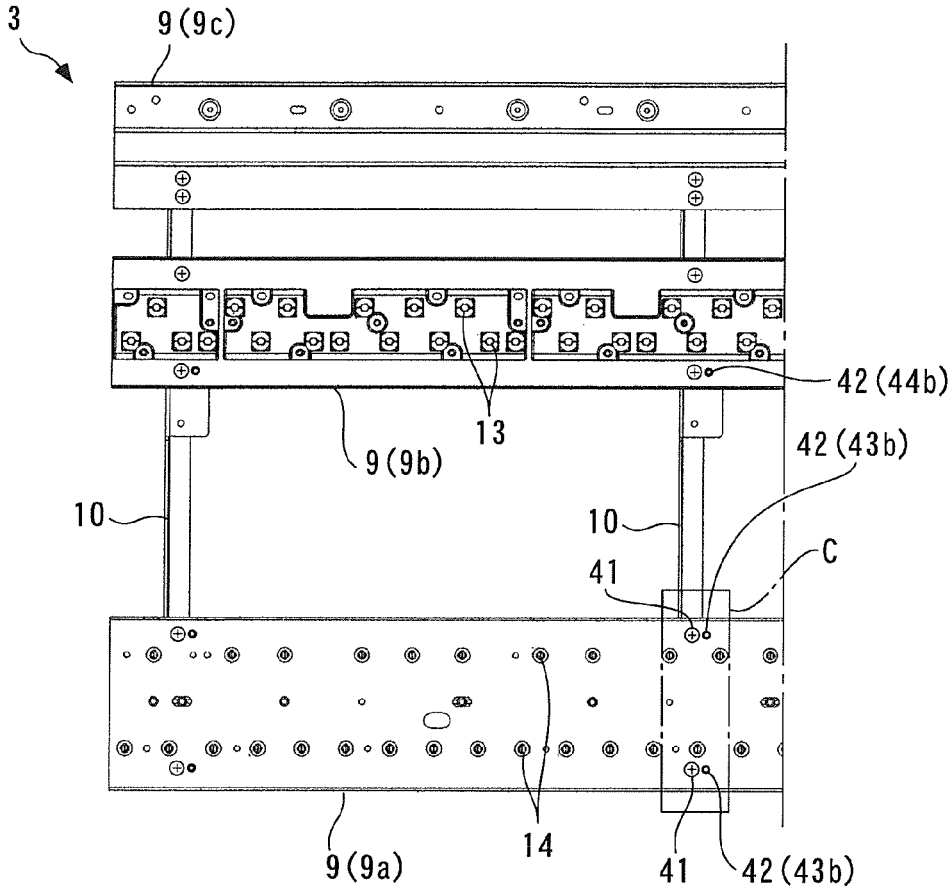
FIG. 2A is a partially cut-away plan view of a keyboard chassis.
Figure 2B:
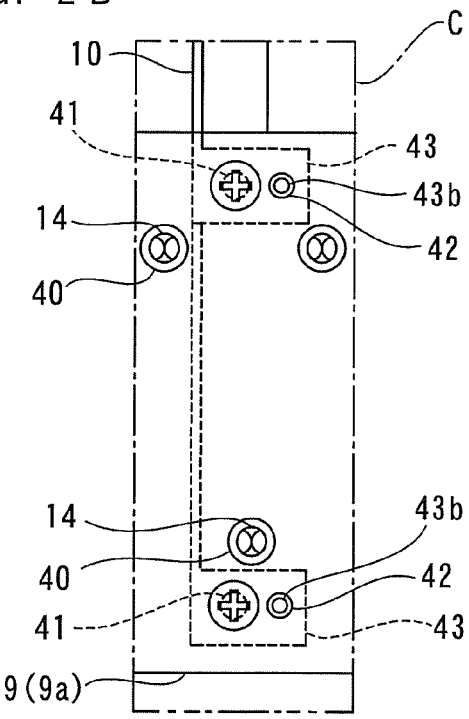
FIG. 2B is an enlarged view of a portion enclosed by a frame C of one-dot chain lines in FIG. 2A.
Figure 3A:
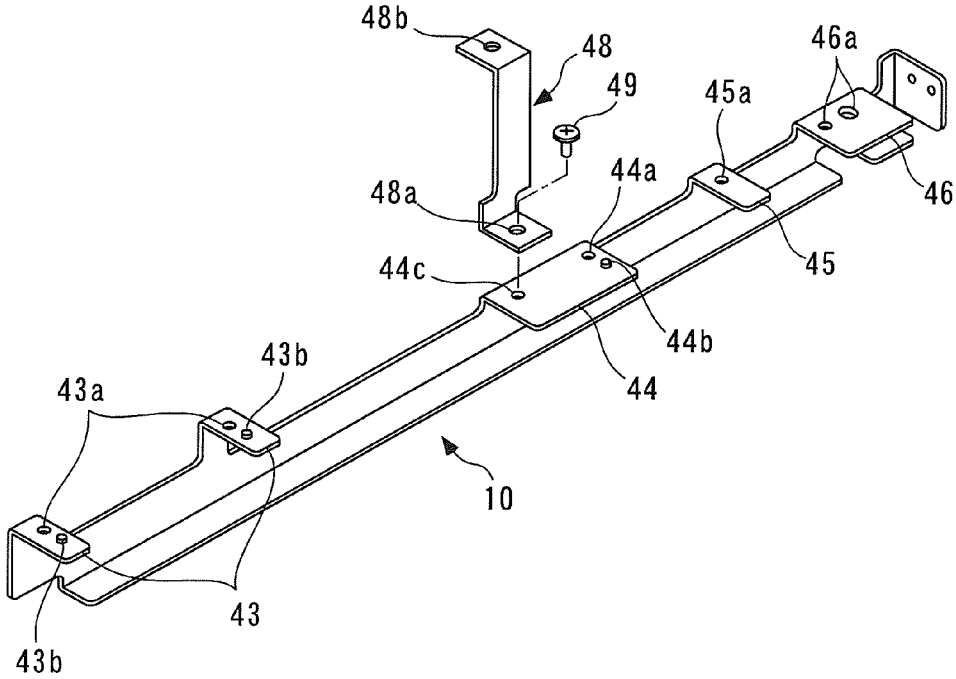
FIG. 3A is a perspective view of a rib and a panel support fitting.

Next, the keyboard device 1 according to the present invention will be described in more detail. FIG. 2A partially shows the keyboard chassis 3, and FIG. 3A shows the rib 10. The front rail 9*a* of the keyboard chassis 3 is formed with a plurality of holes 40 associated with the respective front pins 14, and each of the front pins 14 extends upward through an associated one of the holes 40. Further, as shown in FIG. 2B, the front rail 9*a* has pairs of front and rear screw holes 41 and 41 formed in association with the respective ribs 10, and positioning holes 42 formed immediately rightward, as viewed in FIG. 2B, of the respective screw holes 41. The central rail 9*b* has pairs of front and rear screw holes (not shown) formed in association with the respective ribs 10, similarly to the front rail 9*a*, and positioning holes 42 formed immediately rightward, as viewed in FIG. 2B, of the respective front screw holes. Note that the rear rail 9*c* also has pairs of front and rear screw holes (not shown) formed in association with the respective ribs 10.

As shown in FIG. 3A, each rib 10 extends over a predetermined length in the front-rear direction and has an L-shaped cross section. Each of predetermined portions of the rib 10 associated with the respective front, central, and rear rails 9*a*, 9*b*, and 9*c* has an upper end thereof bent rightward, as viewed in FIG. 3A, at right angles. Two front and rear bent portions 43 and 43 associated with the front rail 9*a* each have a screw hole 43*a* formed at a location corresponding to the screw hole 41 of the front rail 9*a* and a protrusion 43*b* formed by half punching at a location corresponding to the positioning hole 42 of the front rail 9*a* in a manner slightly protruding upward. Similarly, two front and rear bent portions 44 and 45 associated with the central rail 9*b* have respective screw holes 44*a* and 45*a* formed at locations corresponding to the respective screw holes 42 of the central rail 9*b*, and the front bent portion 44 has a protrusion 44*b* formed at a location corresponding to the positioning hole 42 of the front the central rail 9*b*. Note that a bent portion 46 associated with the rear rail 9*c* also has two front and rear screw holes 46*a* and 46*a* formed at locations corresponding to the respective front and rear screw holes of the rear rail 9*c*.

In the case of assembling the keyboard chassis 3 such that the front rail 9*a*, the central rail 9*b*, and the rear rail 9*c* constructed as above are connected by the ribs 10, particularly when connecting the front rail 9*a* and the central rail 9*b* with the ribs 10, each rib 10 is screwed to the front rail 9*a* and the central rail 9*b* in a state where the protrusions 43*b* and 44*b* of the rib 10 are inserted in the positioning holes 42 of the front rail 9*a* and the positioning hole 42 of the central rail 9*b*, respectively, and the screw holes 43*a* and 44*a* are aligned with the screw holes 41 of the front rail 9*a* and the screw holes of the central rail 9*b*. By thus assembling the keyboard chassis 3, it is possible to connect the front and central rails 9*a* and 9*b* and each of the ribs 10 to each other with high efficiency while preventing each of the ribs 10 from turning with respect to the front rail 9*a* or the central rail 9*b* e.g. during screwing. Further, the engagement between the projections 43*b* and 44*b* and the positioning holes 42 of the support rails 9 facilitates positioning of the front rail 9*a* and the central rail 9*b*, thereby making it possible to assemble the keyboard chassis 3 with high accuracy.

Figure 3B:
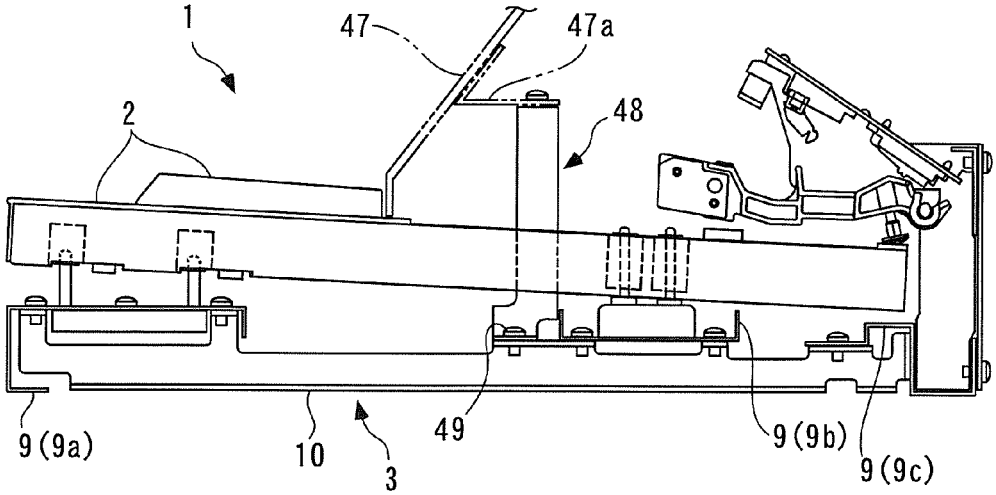
FIG. 3B is a cross-sectional view of the keyboard device in a state where a control panel is supported by the panel support fitting.

The front bent portion 44 of the rib 10 associated with the central rail 9*b* is formed to have a larger dimension in the front-rear direction than the other bent portions 43, 45, and 46, and has a screw hole 44*c* also formed at a location forward of the screw hole 44*a*. This screw hole 44*c* is used for mounting a panel support fitting 48 for supporting a control panel (see FIG. 3B) of the electronic piano, to the rib 10.

The control panel 47 is provided with a number of operating sections (not shown) for configuring a tone color, a sound source, and so forth, and is formed as a whole into a laterally elongated plate shape extending in the left-right direction. The control panel 47 has opposite left and right ends thereof supported by respective left and right arms (not shown) and the like of the electronic piano, and a central portion of the control panel 47 in the left-right direction is secured to the panel support fitting 48 with screws via a connection fitting 47*a* fixed to the back surface of the control panel 47.

The panel support fitting 48 is formed by bending the opposite ends of a metal plate having a predetermined long and narrow shape, at right angles in respective opposite directions. As shown in FIG. 3A, the panel support fitting 48 has a lower end thereof formed with a screw hole 48*a* and an upper end thereof formed with a screw hole 48*b*. The panel support fitting 48 constructed as above is secured to the rib 10 with a screw 49 in a state where the screw hole 48*a* of the lower end is aligned with the front screw hole 44*c* of the bent portion 44 of the rib 10 associated with the central rail 9*b*. Further, when connecting the panel support fitting 48 and the control panel 47 to each other, the connection fitting 47*a* is screwed to the panel support fitting 48 in a state where a mounting hole (not shown) of the connection fitting 47*a* of the control panel 47 is aligned with the screw hole 48*b* of the upper end of the panel support fitting 48.

Figure 4A:
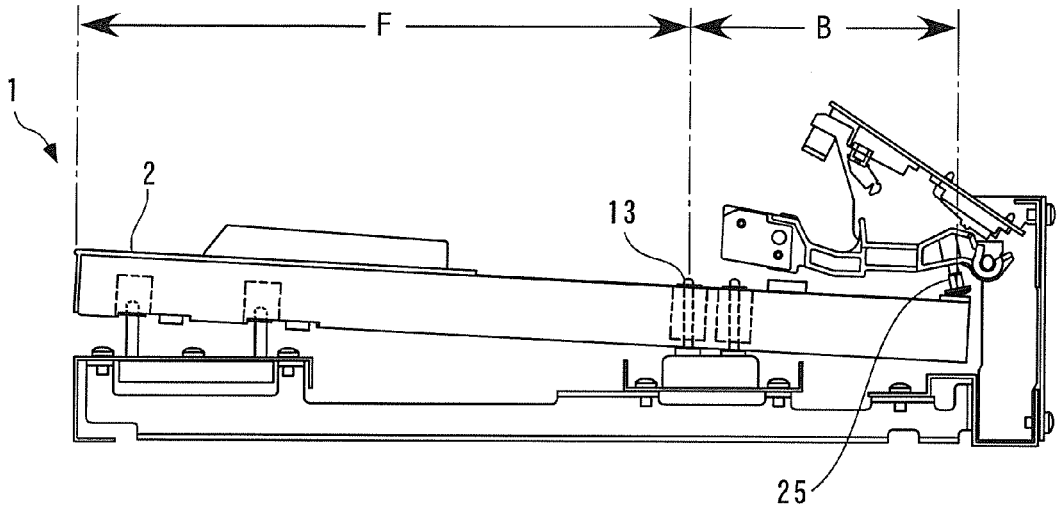
Figure 4B:
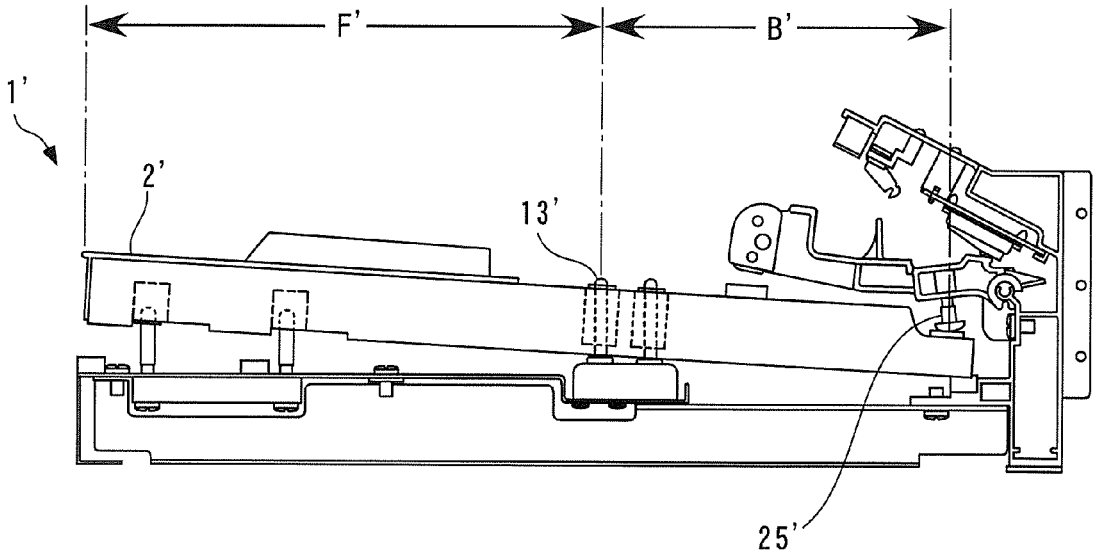
Figure 5A:
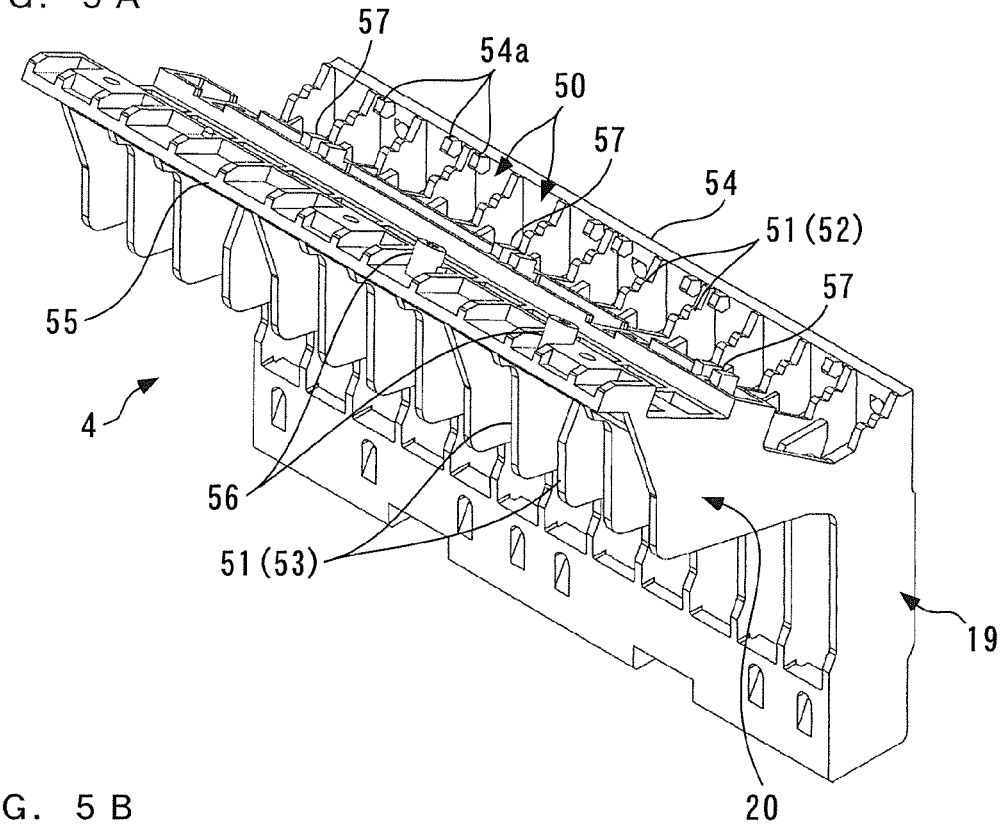
Figure 5B:
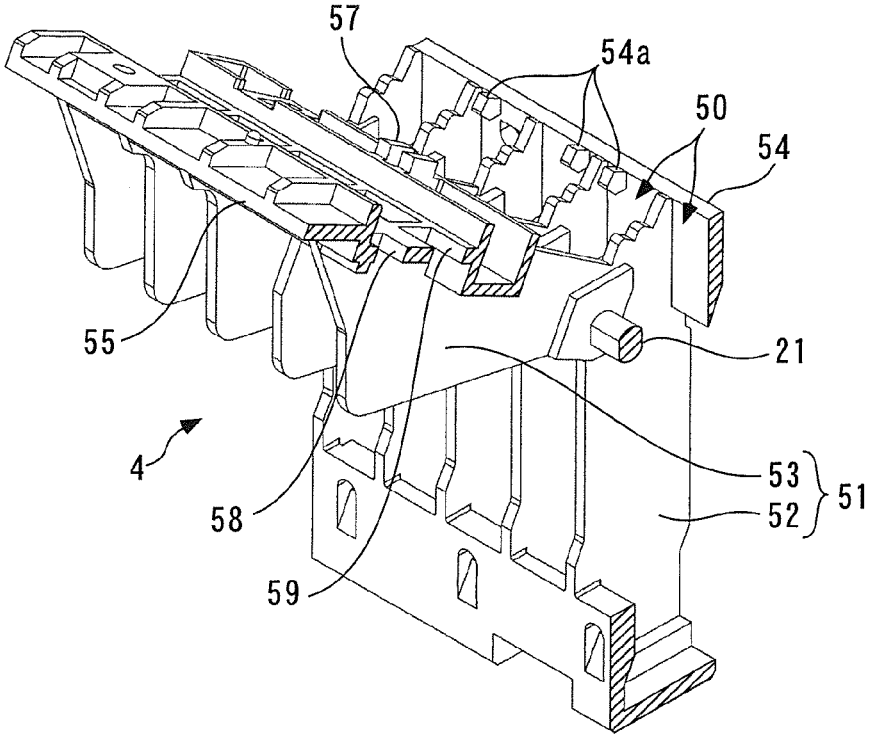
Figure 6A:
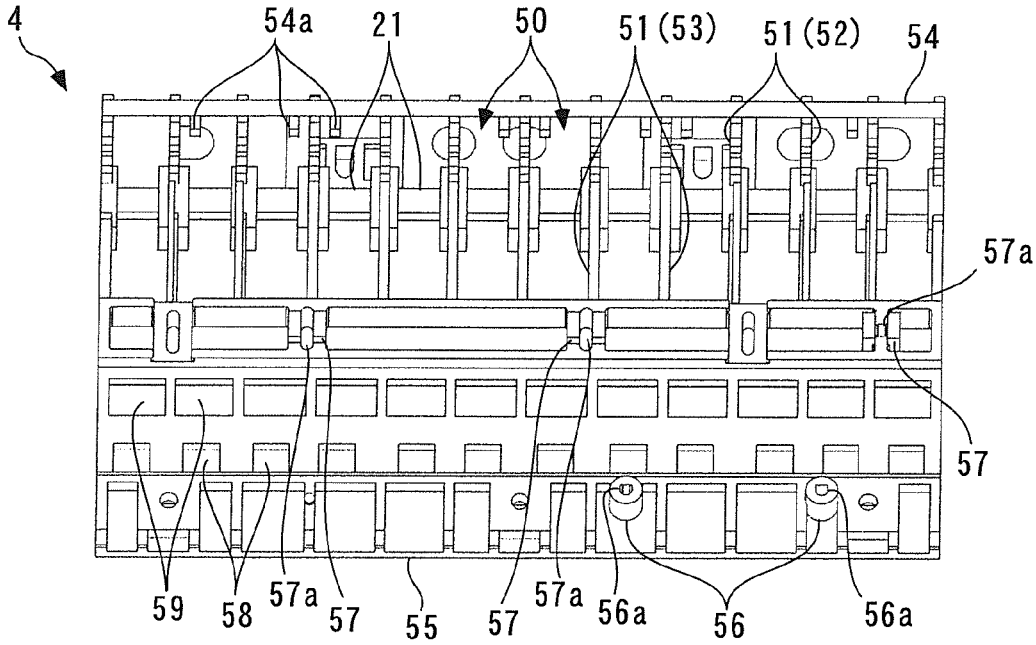
Figure 6B:
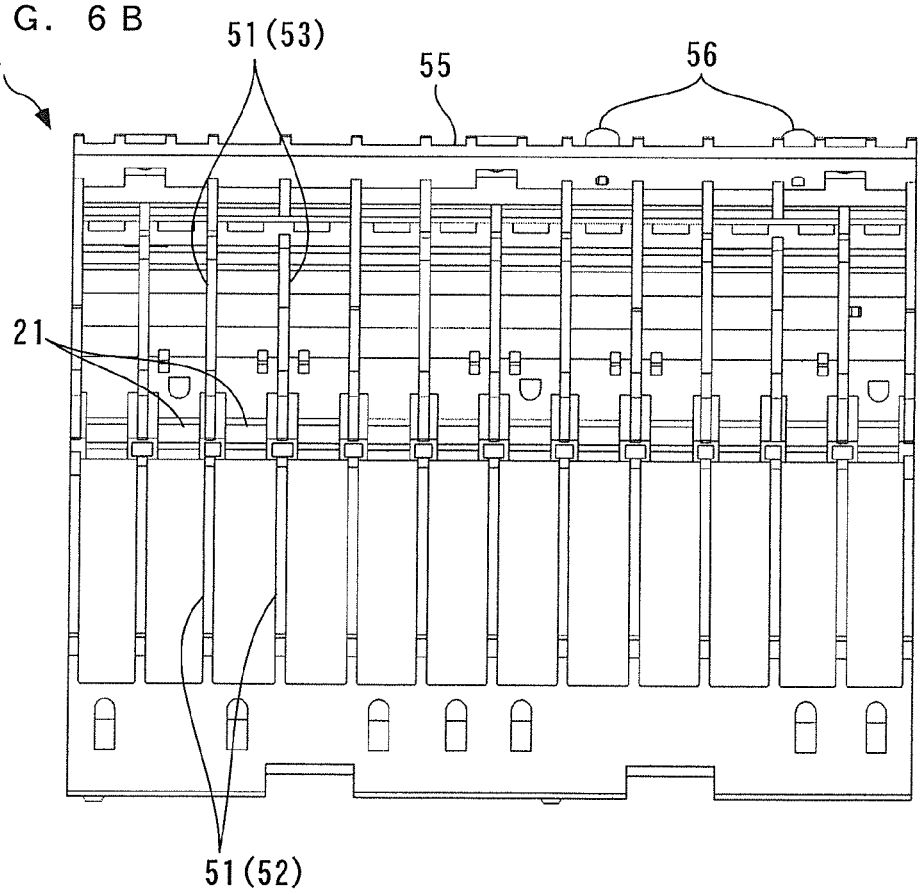

FIG. 4A shows the keyboard device 1 of the present embodiment, and FIG. 4B shows a conventional keyboard device 1' for an electronic piano. As shown in FIG. 4A, the ratio between a key front portion length F defined as a length from the front end of the key 2 to the balance pin 13 and a key rear portion length B defined as a length from the balance pin 13 to the upper-surface rear end (contact portion) of the key 2 with which the capstan screw 25 is in abutment is set within a range of 2:1 to 2.4:1. The key front portion length F is set to approximately the same length as that in a general acoustic grand piano. Specifically, the key front portion length F is set e.g. to approximately 240 mm.

On the other hand, in the conventional keyboard device, denoted by reference numeral 1', shown in FIG. 4B, the ratio between a key front portion length F' defined as a length from the front end of a key 2' to a balance pin 13' and a key rear portion length B' defined as a length from the balance pin 13' to the upper-surface rear end of the key 2' with which a capstan screw 25' is in abutment is set to approximately 3:2.

As is apparent from FIGS. 4A and 4B, the entire length of the key 2 and that of the key 2' are substantially equal to each other, but the key front portion length F of the key 2 in the present embodiment is longer than the key front portion length F' of the conventional key 2'. For this reason, when an electronic piano provided with the keyboard device 1 is played on, for example, the difference in load (load difference) between depression of a portion of the key 2 close to the front end of the same and depression of a portion of the key 2 rearwardly away from the front end is smaller than a difference load between depressions of the key 2' of the conventional keyboard device 1' in respective similar manners, and is approximately the same as a load difference between depressions of a key of an acoustic grand piano in respective similar manners.

Next, a detailed description will be given of the mounting structure of the let-off imparting member according to the present invention. FIGS. 5A and 5B and FIGS. 6A and 6B each show the hammer support 4 covering one octave. The hammer support 4 is formed by a molded article made of a synthetic resin, as mentioned hereinbefore, and has a plurality of partition walls 51 each partitioning between each adjacent ones of the separating hammers 5 in the left-right direction with a predetermined spacing therebetween. Each partition wall 51 is comprised of a square wall 52 corresponding to the hammer supporting part 19 and formed into a generally rectangular and vertically elongated shape in side view, and a triangular wall 53 corresponding to the switch mounting part 20 and formed into a generally triangular shape in side view and continuous with the upper front end of the square wall 52. In the hammer support 4, all the square walls 52 have front ends and lower ends of respective lower portions thereof formed continuous with each other in the left-right direction, and have rear ends of respective upper portions thereof formed continuous with each other in the left-right direction via a rear wall part 54. On the other hand, all the triangular walls 53 have front half portions of respective upper portions formed continuous with each other in the left-right direction via an upper wall part 55.

A plurality of board latching parts 54*a* are formed on an upper end of a front surface of the rear wall part 54, at respective locations close to the upper ends of the square walls 52, as required, in a manner protruding obliquely upward and frontward from the rear wall part 54. The switch board 29 of the key switch 7 is latched in a state where the rear end thereof is inserted between each of these board latching parts 54*a* and each square wall 52 close thereto.

The upper wall part 55 has a front end of the upper surface thereof formed with a plurality of (two in the present embodiment) screwing parts 56 each having a screw hole 56*a* and protruding upward by a predetermined length, and a rear end of the upper surface thereof formed with a plurality of (three in the present embodiment) board supporting parts 57 each protruding upward by a predetermined length. Each board supporting part 57 is comprised of a pair of protrusions arranged in the left-right direction with a slight spacing therebetween, and a screw hole 57*a* formed between the two protrusions. Further, the upper wall part 55 has a plurality of mounting holes 58 each formed between associated adjacent partition walls 51 and 51 (triangular walls 53 and 53), for use in mounting the associated let-off member 6. Note that an opening 59 is formed in the upper wall part 55 at a location rearward of each mounting hole 58 so as to prevent the engaging projection 27 of the hammer 5 for engagement with the let-off member 6 from abutting on the upper wall part 55 when the hammer 5 pivotally moves upward.

These mounting holes 58 are formed in association with the respective hammers 5 supported by the hammer support 4, in a manner arranged side by side in the left-right direction. The mounting holes 58 are each formed into a square planar shape having a predetermined size, and are common in respect of positions other than those in the left-right direction, i.e. common in respect of positions in respect of both of the vertical direction and the front-rear direction. Further, on the lower surface of the upper wall part 55, there is formed an abutment wall 60 (see FIG. 9B) extending in the left-right direction and slightly protruding downward from the front-side edge of the mounting hole 58. A rear engaging protrusion 77, referred to hereinafter, of the let-off member 6 comes into abutment with the abutment wall 60.

Further, between the adjacent partition walls 51 and 51, the fulcrum shaft portion 21 extending in the left-right direction is provided at a portion where each partition wall 51 and each associated square wall 52 merge with each other. The hammers 5 are pivotally supported by the respective fulcrum shaft portions 21 as described hereinbefore.

Figure 7:
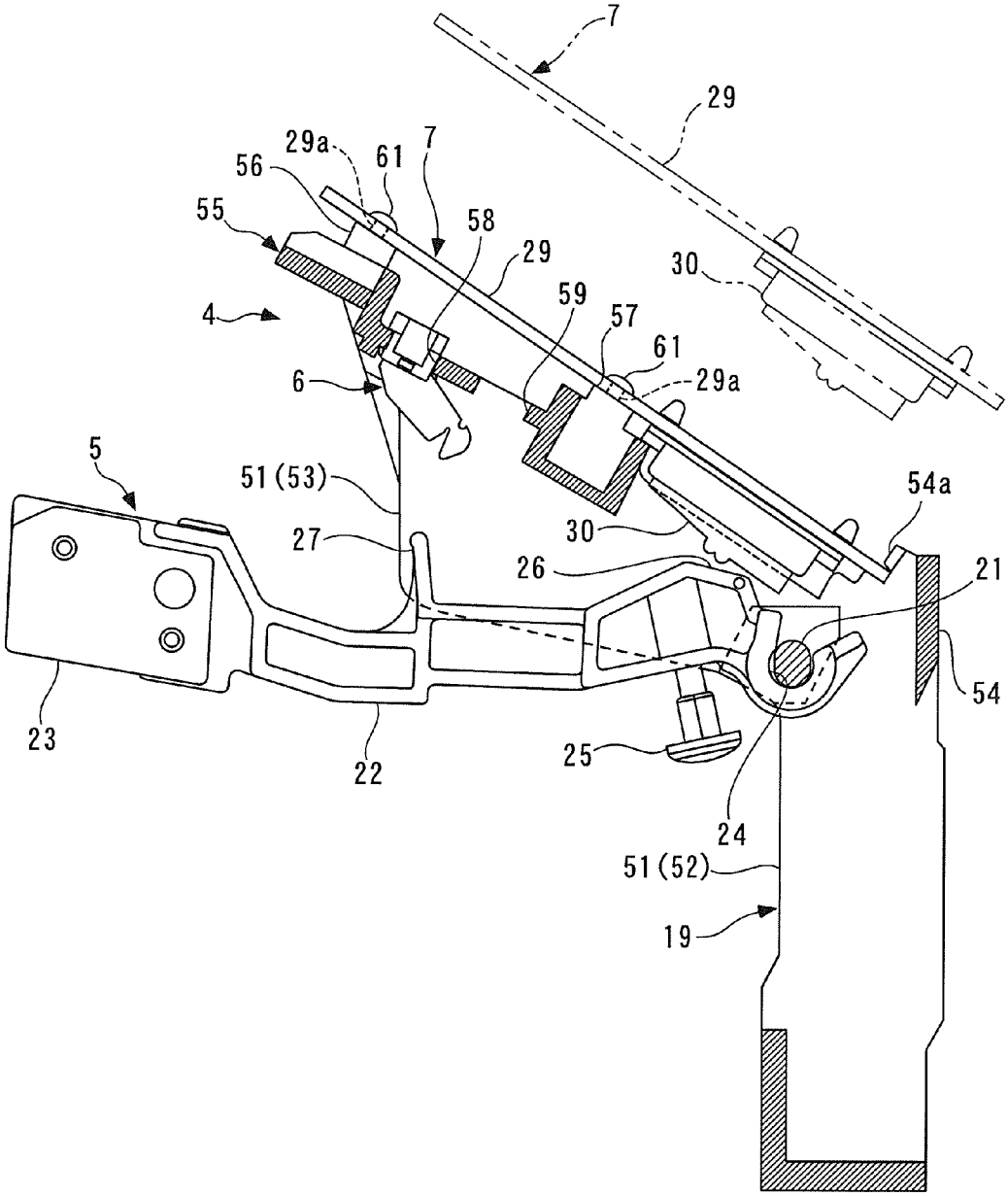
FIG. 7 is a side cross-sectional view of the hammer support in a state having hammers, let-off members, and a key switch mounted thereto, together with an imaginary state of the key switch dismounted from the hammer support.

FIG. 7 shows the hammer support 4 in a state having the hammers 5, the let-off members 6, and the key switch 7 mounted thereto, together with an imaginary state of the key switch 7 dismounted from the hammer support 4. As shown in FIG. 7, the key switch 7 is removably mounted to the hammer support 4 in a state placed on the upper surface, as viewed in FIG. 7, of the switch mounting part 20 of the hammer support 4.

Specifically, the switch board 29 of the key switch 7 is latched in a state where the rear end (right end as viewed in FIG. 7) thereof is inserted between each of the board latching parts 54*a* of the rear wall part 54 and each square wall 52 close thereto, the central portion thereof placed on the board supporting parts 57 of the upper wall part 55, and the front end thereof placed on the screwing parts 56 of the upper wall part 55, as described hereinabove. Mounting holes 29*a* are formed in the front end and central portion of the switch board 29 at locations corresponding to the respective screw holes 56*a* and 57*a* of the hammer support 4, and screws 61 are screwed from above into the screw holes 56*a* of the respective screwing parts 56 and the screw holes 57*a* of the respective board supporting parts 57 via the associated mounting holes 29*a*, respectively. Each of the switch bodies 30 of the switch board 7 faces the actuator portion 26 of an associated one of the hammers 5 from above via an associated opening 50 (see FIGS. 5A and 5B and 6A and 6B) defined by the partition walls 51 and 51 on the opposite sides of the hammer 5, the rear wall part 54, and the upper wall part 55 in a manner vertically extending through the hammer support 4.

As can be understood from the above, it is possible to easily mount the key switch 7 to the hammer support 4 from above. Further, by removing the screws 61 from the screwing parts 56 of the hammer support 4 and the screw holes 56*a* and 57*a* of the board supporting parts 57, it is possible to easily dismount the key switch 7 from the hammer support 4.

As described above in detail, according to the present embodiment, it is possible to mount the key switch 7 to the switch mounting part 20 of the hammer support 4 from above or dismount the key switch 7 upward from the switch mounting part 20, which facilitates work for mounting and dismounting the key switch 7. Further, since the hammer support 4 is formed by a molded article of a synthetic resin, it is possible not only to form the hammer support 4 itself accurately, but also to install the hammers 5 to be pivotally supported by the hammer support 4 and the key switch 7 to be mounted to the hammer support 4, with high accuracy. Consequently, even when the key front portion length F is set to be longer and the key rear portion length B is set to be shorter than the respective lengths of the key 2' of the conventional keyboard device 1' for an electronic piano, it is possible to accurately detect key depression information on a depressed key 2, by the key switch 7 having an associated switch body 30 pressed by the hammer 5 pivotally moved by depression of the key 2.

Furthermore, the ratio between the key front portion length F and the key rear portion length B of the key 2 is set within the range of 2:1 to 2.4:1 in the keyboard device 1, and the key front portion length F is set to approximately the same length as that of a key of an acoustic grand piano. Therefore, it is possible to keep the keyboard device 1 as compact in the depth dimension as the conventional keyboard device 1' for an electronic piano, and to obtain a touch feeling similar to a touch feeling provided by the acoustic grand piano.

Figure 8A:
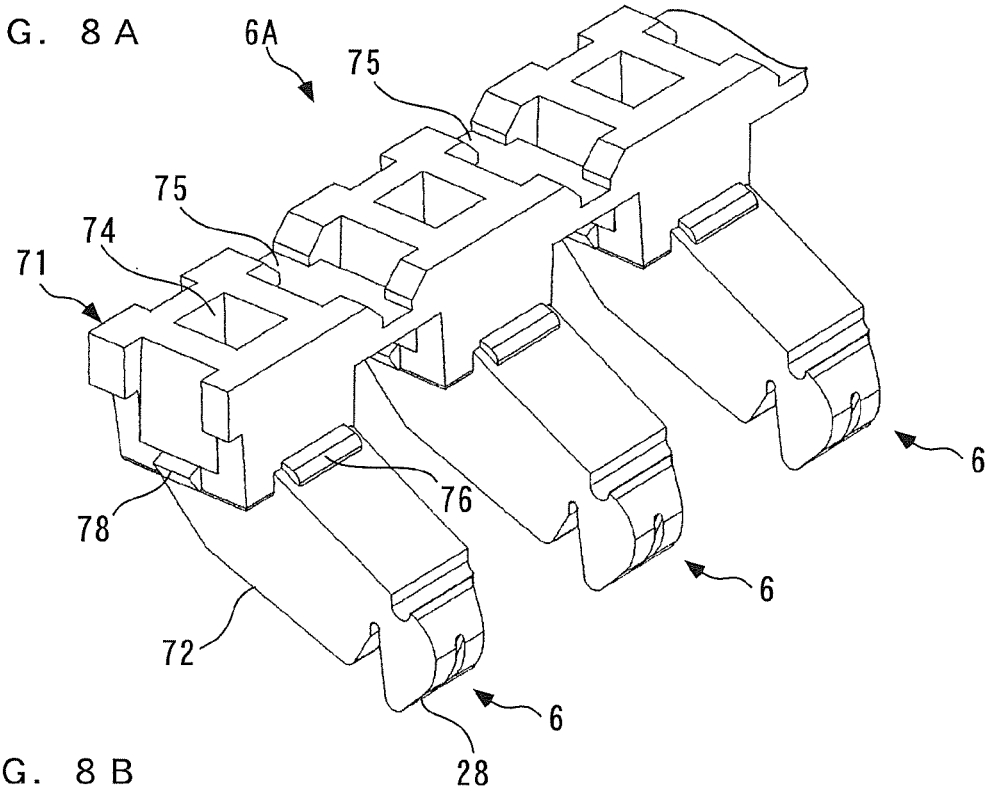
Figure 8B:
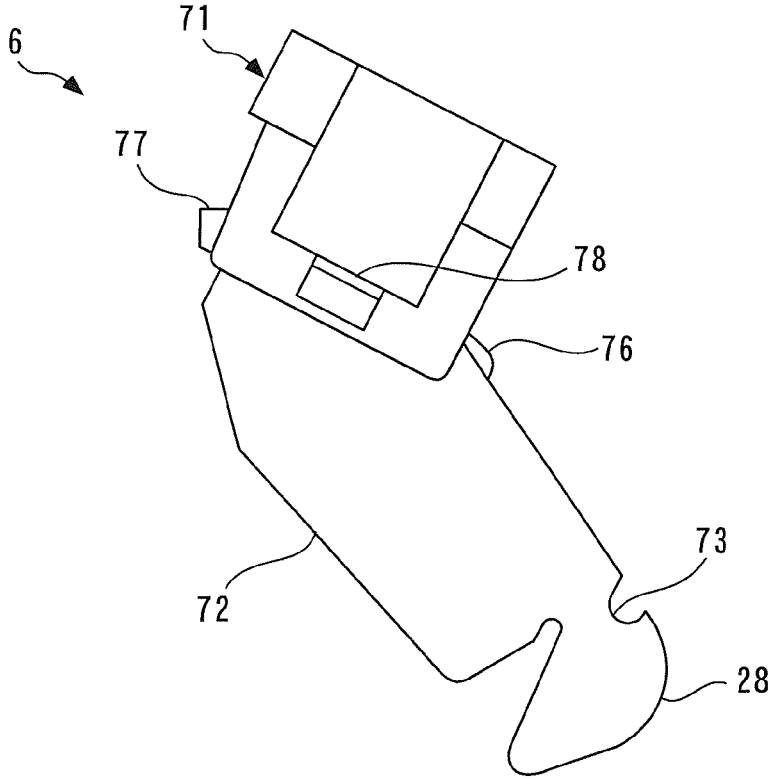

FIG. 8A shows part of a set article 6A in which a set of twelve let-off members 6 (only three are shown) for one octave are integrally molded such that the let-off members 6 are continuous with each other, and FIG. 8B is a side view of the left-off member 6. As shown in FIGS. 8A and 8B, the let-off member 6 is comprised of a mounting part 71 for mounting the let-off member 6 itself to the upper wall part 55 of the hammer support 4, a body part 72 extending forward and downward from the lower end of the mounting part 71, and the head part 28 projecting from the distal end of the body part 72 via the neck part 73.

The mounting part 71 is formed into a block shape having an upwardly open hollow portion 74, and let-off members 6 and 6 adjacent to each other are continuously arranged in the left-right direction via connecting parts 75 of the upper end of the mounting part 71. The lower end of the mounting part 71 is formed with a front engaging protrusion 76 protruding from a front side of the mounting part 71 defined in terms of a direction in which the body part 72 extends forward and downward and the aforementioned rear engaging protrusion 77 protruding from a rear side of the same extending in an opposite direction to the direction in which the body part 72 extends forward and downward. Further, the lower end of the mounting part 71 is formed with lateral engaging protrusions 78 protruding from the respective left and right sides in opposite directions in which respective adjacent let-off members 6 merge. As for the mounting part 71, a transverse cross-section of an imaginary space defined between the connecting part 75 of the upper end and the front, rear, left, and right engaging projections 76, 77, and 78 and 78 of the lower end is approximately identical in shape and size to the mounting hole 58 of the hammer support 4.

The body part 72 extends forward and downward over a predetermined length from the lower end of the mounting part 71. The body part 72 is formed into a shape having a transverse cross-sectional area slightly reduced toward the distal end of the body part 72. The head part 28 has a convexly curved distal end.

Figure 9A:
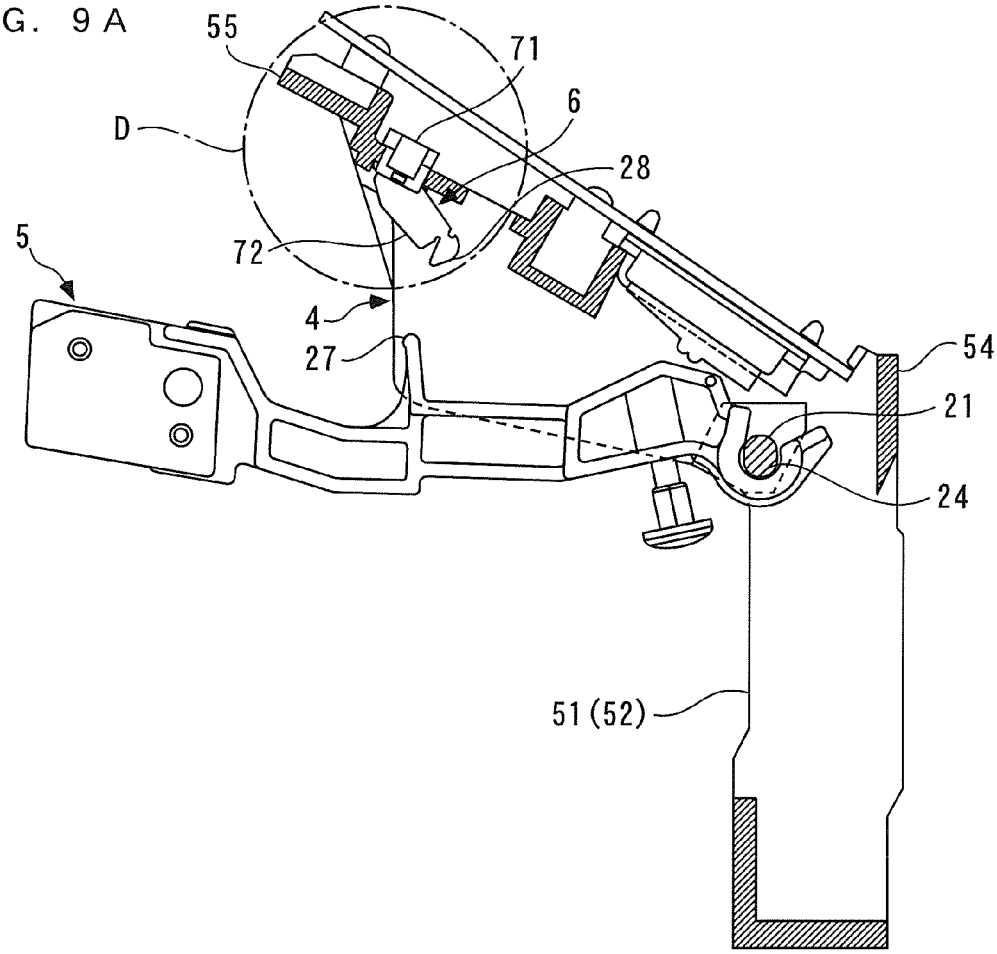
FIG. 9A is a side cross-sectional view of the hammer support having the hammers, the key switch, and the let-off members mounted thereto.
Figure 9B:
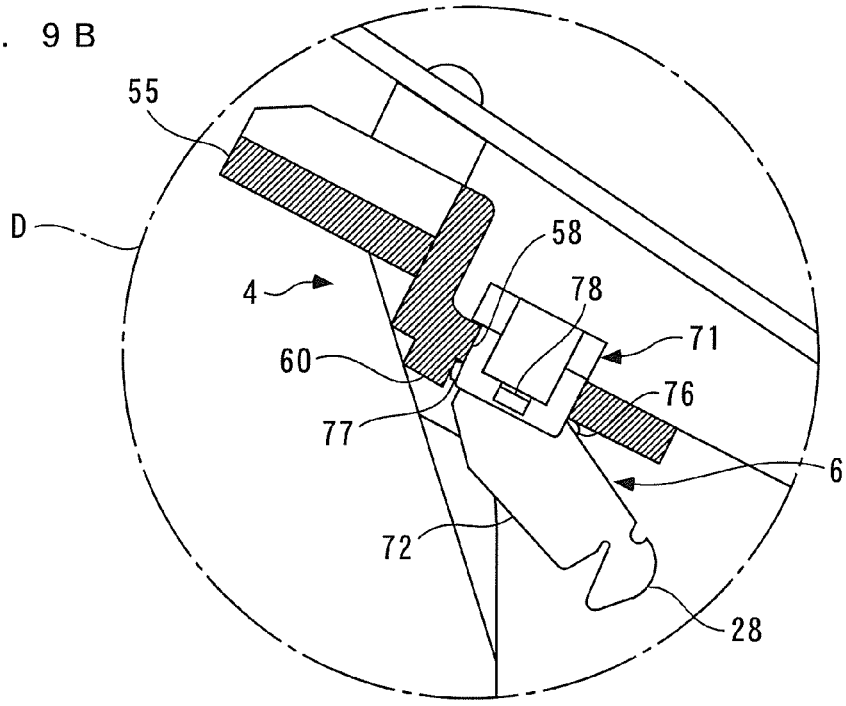
FIG. 9B is an enlarged view of a portion enclosed by a circle D of one-dot chain lines in FIG. 9A.

The set article 6A having the let-off members 6 configured as above is mounted to the upper wall part 55 of the hammer support 4. Specifically, as shown in FIGS. 9A and 9B, each of the let-off members 6 is mounted to the upper wall part 55 via the mounting hole 58. In this case, the mounting part 71 is mounted through the mounting hole 58 of the upper wall part 55, and the connecting part 75 is latched on the upper side edges of the mounting hole 58. On the other hand, the front engaging protrusion 76, the rear engaging protrusion 77, and the left and right lateral engaging projections 48 and 48 are latched on the lower edges of the mounting hole 58.

Further, in this case, the rear engaging protrusion 77 is in abutment with the abutment wall 60 of the upper wall part 55. More specifically, the rear engaging protrusion 77 is in abutment with the abutment wall 60 in a state slightly compressed by the let-off member-side surface of the abutment wall 60. Note that the rear engaging protrusion 77 corresponds to "a portion of each of the let-off imparting members which is lower than the associated mounting hole and is on a side opposite from a front end thereof in terms of a direction in which the body part extends" in the present invention.

The rear engaging protrusion 77 of each of the let-off members 6 is held in abutment with the abutment wall 60 of the upper wall part 55 as described above, and hence in the set article 6A mounted to the upper wall part 55 via the mounting holes 58, the body parts 72 of the respective let-off members 6 become identical in the inclined attitude whereby the head parts 28 also become identical in position.

As described above in detail, according to the present embodiment, since the let-off members 6 are directly mounted to the hammer support 4 pivotally supporting the hammers 5, the let-off members 6 can be positioned with respect to the respective hammers 5 with high accuracy differently from the conventional let-off members mounted via a holder. Further, the let-off members 6 of the set article 6A have their mounting parts 71 mounted in the respective mounting holes 58 common in position in the vertical and front-rear directions, and are held in abutment with the abutment walls 60 via the respective rear engaging projections 47. Therefore, so that it is possible to uniformly align all the let-off members 6 of the set article 6A in position and attitude in the left-right direction without causing any variation between the let-off members 6. Thus, a let-off feeling can be uniformly and stably imparted to each of the keys 2 during key depression.

Note that the present invention is by no means limited to the embodiment described above, but it can be practiced in various forms. Further, the detailed construction of the keyboard device 1 including the hammer support 4 and the let-off members 6 in the above-described embodiment is also given by way of example, and it can be changed, as desired, within the subject matter of the present invention.

It is further understood by those skilled in the art that the foregoing is a preferred embodiment of the invention, and that various changes and modifications may be made without departing from the spirit and scope thereof.

What is claimed is:

1. A keyboard device for an electronic keyboard instrument, comprising:

a plurality of keys each extending in a front-rear direction and configured to be swingable about a fulcrum disposed at a predetermined location in the front-rear direction;

a hammer support formed by a molded article of a synthetic resin and disposed rearward of said keys;

a plurality of hammers each pivotally supported by said hammer support and held in abutment with an abutment portion of a rear end of an associated one of said keys from above, for pivotal motion in accordance with depression of said associated key; and a key switch including a plurality of switch bodies provided in association with said respective hammers and a switch board having said switch bodies mounted on a lower surface thereof, said key switch being configured to be operable when any of said hammers configured to pivotally move in accordance with depression of said respective keys presses an associated one of said switch bodies, to detect key depression information on said depressed key, wherein said hammer support has a switch mounting part located above said hammers and formed with an opening vertically extending therethrough, and wherein said key switch is removably mounted to said switch mounting part, such that said switch bodies face said respective hammers from above via the opening of said switch mounting part and said switch board is placed on an upper surface of said switch mounting part.

2. The keyboard device according to claim 1, wherein each of said keys is configured such that a ratio between a key front portion length defined as a length from a front end of said key to the fulcrum and a key rear portion length defined as a length from the fulcrum to the abutment portion is set to be within a range of 2:1 to 2.4:1.

3. The keyboard device according to claim 2, wherein the key front portion length of each of said keys is set to be approximately equal to a key front portion length of each key swingable about an associated fulcrum in an acoustic grand piano.

4. A mounting structure of a let-off imparting member for an electronic keyboard instrument, provided in a keyboard device of the electronic keyboard instrument, which has a let-off function for imparting a let-off feeling similar to a let-off feeling provided by an acoustic piano, and is configured to be operable when a hammer pivotally moving in accordance with depression of a key comes into temporary engagement with the let-off imparting member during halfway through the pivotal motion, to thereby impart the let-off feeling to a touch feeling provided by the depressed key, the mounting structure comprising a hammer support for pivotally supporting the hammer, wherein the let-off imparting member is directly mounted to said hammer support.

5. The mounting structure of a let-off imparting member according to claim 4, wherein the let-off imparting member comprises a plurality of let-off imparting members, and each of said let-off imparting members includes a mounting part, and a body part extending forward and downward from a lower end of said mounting part toward an associated hammer, and wherein said hammer support comprises:

a hammer supporting part for pivotally supporting a plurality of hammers associated with a plurality of keys, respectively, in a state arranged side by side in a left-right direction, a plurality of mounting holes formed in a manner associated with the hammers, respectively, and arranged side by side in the left-right direction, such that each of said let-off imparting members is mounted therein, in a state in which said mounting part is inserted therethrough, and an abutment wall formed at a location close to the mounting holes in a manner protruding downward, for abutment with a portion of each of said let-off imparting members which is lower than the associated mounting hole and is on a side of said body part opposite from a front end thereof in terms of a direction in which said body part extends.

* * * * *